US007261035B1

(12) United States Patent
Munsinger

(10) Patent No.: US 7,261,035 B1
(45) Date of Patent: Aug. 28, 2007

(54) METHOD AND SYSTEM FOR OPERATION OF A SAFE AND ARM DEVICE

(75) Inventor: Terrence Lane Munsinger, Ridgecrest, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 355 days.

(21) Appl. No.: 11/053,754

(22) Filed: Jan. 31, 2005

(51) Int. Cl.
*F42C 15/44* (2006.01)

(52) U.S. Cl. ..... 102/254; 102/200; 102/215; 102/221; 102/226

(58) Field of Classification Search ..... 102/200, 102/215, 221, 226, 254
See application file for complete search history.

(56) References Cited

U.S. PATENT DOCUMENTS 4,586,436 A * 5/1986 Denney et al. ..... 102/206
5,696,347 A * 12/1997 Sebeny et al. ..... 102/214
6,295,932 B1 * 10/2001 Kane, III ..... 102/221
6,584,906 B2 * 7/2003 Hartmann et al. ..... 102/211
6,622,629 B2 * 9/2003 Hodge et al. ..... 102/235
2003/0047102 A1 * 3/2003 Hartmann et al. ..... 102/211

OTHER PUBLICATIONS

Terrence Lane Munsinger, Fuzzy Logic Fuzing Safe/Arm Rate Control, research paper submitted at California State University at Chico, Mar. 24, 2004.

* cited by examiner

*Primary Examiner*—Troy Chambers
(74) *Attorney, Agent, or Firm*—Brian F. Drazich

(57) ABSTRACT

A method and a system controlling the operation of a safe and arm device. The embodiments include continually utilizing a rule based computation to generate an output signal to be sent to a controller affecting the operation of the safe and arm (S&A) device towards the safe condition or towards the armed condition.

7 Claims, 5 Drawing Sheets

METHOD AND SYSTEM FOR OPERATION OF A SAFE AND ARM DEVICE

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The present invention relates generally to a method and system for operating a safe and arm device, and more particularly to a method and system to control the rate of change of the condition of the device towards a safe or towards an armed position.

BACKGROUND OF THE INVENTION

The primary purpose of a safe and arm (S&A) device is to prevent accidental functioning of a main charge of explosive (military or otherwise) in a fuze prior to arming. Typically, in an electro-mechanical S&A device, a sensitive primary explosive is physically separated from a booster explosive by an interrupter or barrier component. The barrier component, often a slider or rotor, interrupts the explosive path and thus prevents detonation of the booster and main charge prior to arming. Arming occurs by moving the barrier component to align the explosive elements. In the case of an electrical S&A device, the detonator includes a firing capacitor. In order to place the S&A device in a safe condition, the firing capacitor's charge is discharged, thereby preventing any energy from reaching the detonator.

In many applications, the S&A device functions to prevent arming of the fuze until a pre-programmed or designed sequence of environmental events have been sensed and compared. Once this sequence of events has been sensed, the S&A device operates to remove the safety features and progress into the armed condition by, for example, aligning the elements of the firing train.

To assure maximum safety for the user of today's modern munition systems, one environmental event the S&A device may require to allow movement from a safe to an armed condition is a safe separation distance between the source of the munition (such as a launcher) and the munition's warhead. Due to the high "g" maneuvering ability of today's munitions, it is possible that an armed munition could re-enter the launcher's safe separation envelope due to the combined vectors of the launcher, the target, and the munition, which is tracking the target, or is being directed by a different method (AWACS, laser designator, etc.). This safe separation envelope between the launcher and the launched munition precludes inadvertent blast and/or fragmentation damage to the launch platform. Therefore, there is a need for a method of continually controlling the operation of a S&A device according to the requirement of a safe separation envelope between a launcher and a munition.

SUMMARY OF THE INVENTION

An embodiment of the present invention includes a method for controlling the operation of a safe and arm device including determining membership functions that define values of inputs and outputs necessary to operate the safe and arm device; determining linguistic values for each of the input and output membership functions, with the probable state of each of the linguistic values graphically represented; and determining repeatedly an actual state of each of the linguistic values of the input membership functions. The embodiment further includes: composing rules for an interrelation between the input and output membership functions; applying repeatedly a rule based computation to the input membership functions resulting in output membership functions; determining repeatedly a centroid of a composite area of the output membership functions, the centroid being a single output signal; and sending repeatedly the single output signal to a controller operating the safe and arm device to affect the condition of the safe and arm device alternatively towards a safe position or an armed position.

Another embodiment of the present invention includes a system to operate a safe and arm device including: a plurality of sensors each repeatedly providing actual states of input membership function linguistic values; a processor for repeatedly applying a rule based computation to the actual states of input membership function linguistic values and generating a single output signal; and a controller for receiving repeatedly the single output signal, thereby affecting the operation of the safe and arm device, in response to the single output signal, alternatively towards the a safe position or an armed position.

It is to be understood that the foregoing general description and the following detailed description are exemplary and explanatory only and are not to be viewed as being restrictive of the present invention, as claimed. The present invention is capable of other and different embodiments, and its several details are capable of modifications in various obvious respects, all without departing from the invention. Accordingly, the drawings and description are to be regarded as illustrative in nature, and not as restrictive.

DETAILED DESCRIPTION OF THE INVENTION

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation. In the figures the same reference numbers are used to identify the same components.

Embodiments of the present invention include a method and a system controlling the operation of a safe and arm device. The embodiments include utilizing a rule based computation to generate an output signal to be sent to a controller affecting the operation of the safe and arm (S&A) device towards the safe condition or towards the armed condition. By incorporating a rule based computation (such as fuzzy logic) into the arming rate control of an S&A device, the integrity of the launcher's safe separation envelope shall be maximized while at the same time ensuring that maximum lethality is delivered to the target.

A safe and armed device functions to prevent inadvertent arming of a fuze until a controller receives a signal that environmental conditions meet the requirements for a safe detonation. For example, in the case of a munition launched from an aircraft (such as, for example an air intercept missile (AIM)), it is a requirement that a safe separation distance is established between the launcher and the munition. Safe separation distance is defined as, the minimum distance between the delivery system (or launcher) and the launched munition beyond which the hazards to the delivery system and its personnel resulting from the functioning of the munition are acceptable. (ML-STD-1316E, Paragraph 3.29) In an embodiment of the present invention a processor applies a rule based computation, such as fuzzy logic software, to compare the status of the munition and the location of the launcher and generate a corresponding output signal to the controller operating the safe and arm device. (An example of a fuzzy logic software is the Matlab® Fuzzy Logic Toolbox.) The rule based computation may be of the Mamdani type or the Takagi-Sugeno-Kang type, though one of skill in the art may apply other types of rule based computations within the scope of the present invention.

Figure 1:
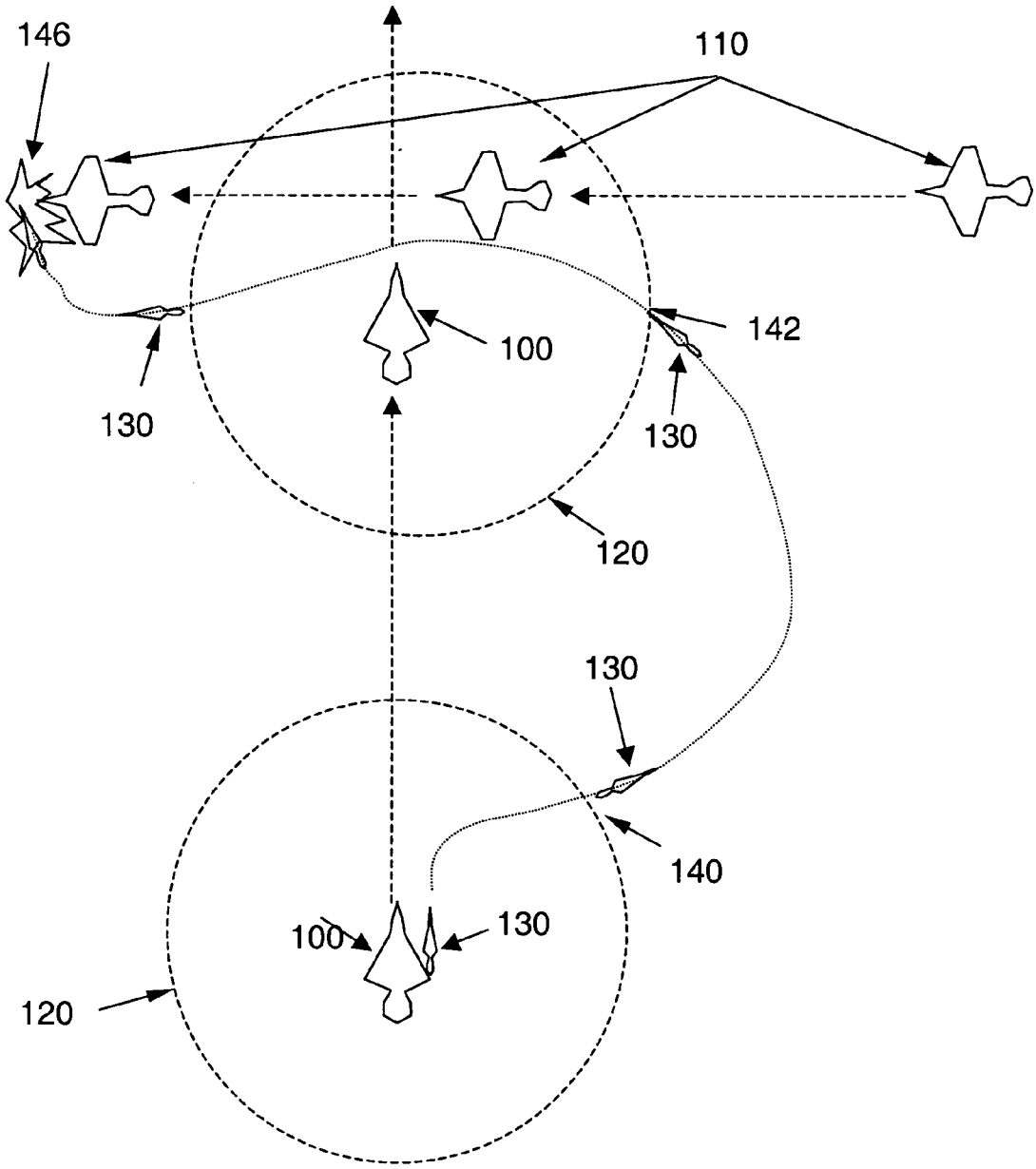
FIG. 1 is a conceptual drawing illustrating an example of an engagement scenario according to embodiments of the present invention.

FIG. 1 is a conceptual drawing illustrating an example of an engagement scenario according to embodiments of the present invention. The figure describes of the operation of an embodiment of the present invention during a two dimensional dogfight engagement scenario between two aircraft. The target aircraft 110 is on a perpendicular vector to the launcher aircraft 100. The safe separation envelope 120 of the launcher 100 is shown. When the AIM 130 is launched it achieves safe separation (shown at 140) from the launcher 100 and the S&A device (not shown) moves into the armed position. Due to the movement of the target aircraft 110 the AIM 130 turns back towards the launcher 100, and reenters the safe separation envelope 120 (shown at 142) and begins to move the S&A device towards the safe position. When the AIM 130 leaves the safe separation envelope 120 again the S&A device moves towards the armed position in time to intercept the target aircraft 110 (shown at 146).

Figure 2:
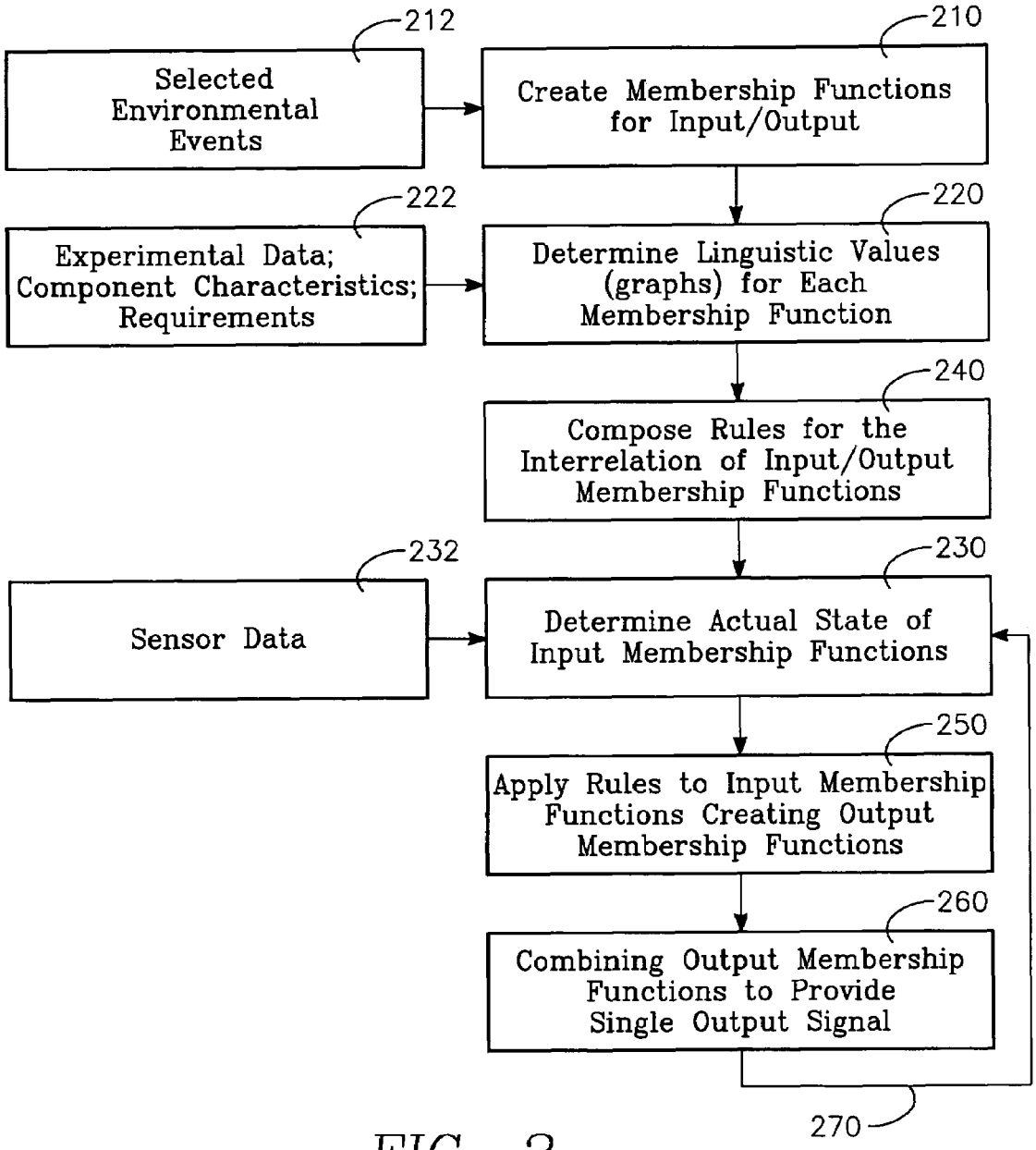
FIG. 2 is a flow chart of a method for operating a S&A device according to embodiments of the present invention.

Referring to FIG. 2, an embodiment of the present invention begins with the determination of the inputs and output required for the rule based computation to provide control of the S&A device. Input and output membership functions are created 210 to represent the environmental events 212 selected to determine the desired position of the S&A device. For example, three input membership functions may be used such as: "Launcher"—the distance from the launcher 100 to the AIM 130; "RotorPosition"—the position of an interrupter gear operated by the controller in an electro-mechanical S&A device (See FIG. 5A); "SafeSepRate"—representing the increasing or decreasing of the distance between the AIM 130 and the launcher 100. An example of an output membership function may be "ArmRate" referring to the rate at which the interrupter gear described above is rotated towards the safe or armed positions. Each membership function may have a number of linguistic values assigned to the functions 220. The probable states of the linguistic values are graphically represented. The values are treated as weighting factors to determine their influence on the eventual single output signal. The graphs may be established in a number of ways including by experimental data, by the characteristics of the components, or requirements (such as the safe separation distance) 222.

Figure 3A:
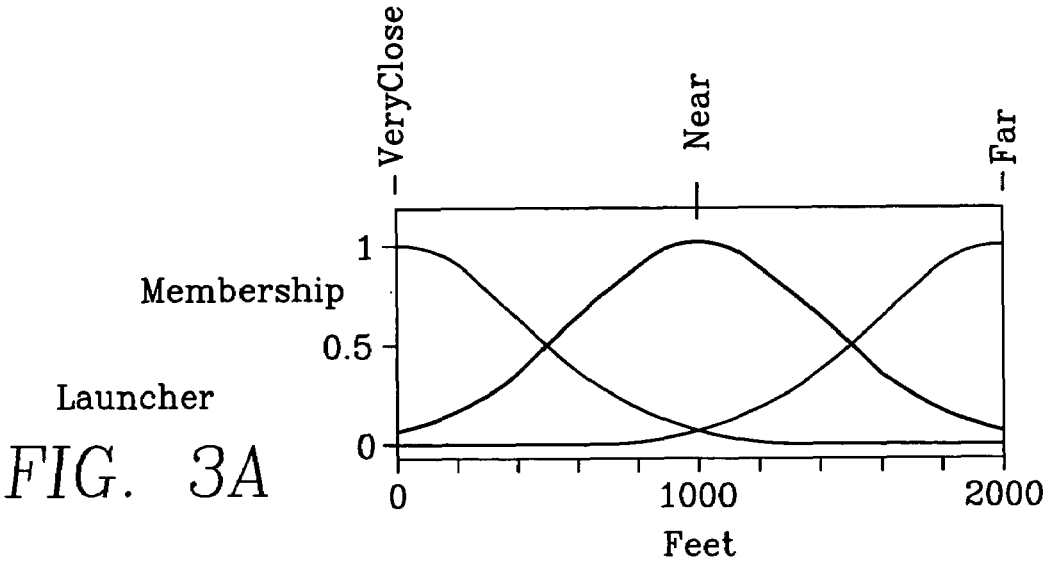
FIGS. 3A-D illustrate graphical representations of examples of membership functions according to embodiments of the present invention.
Figure 3B:
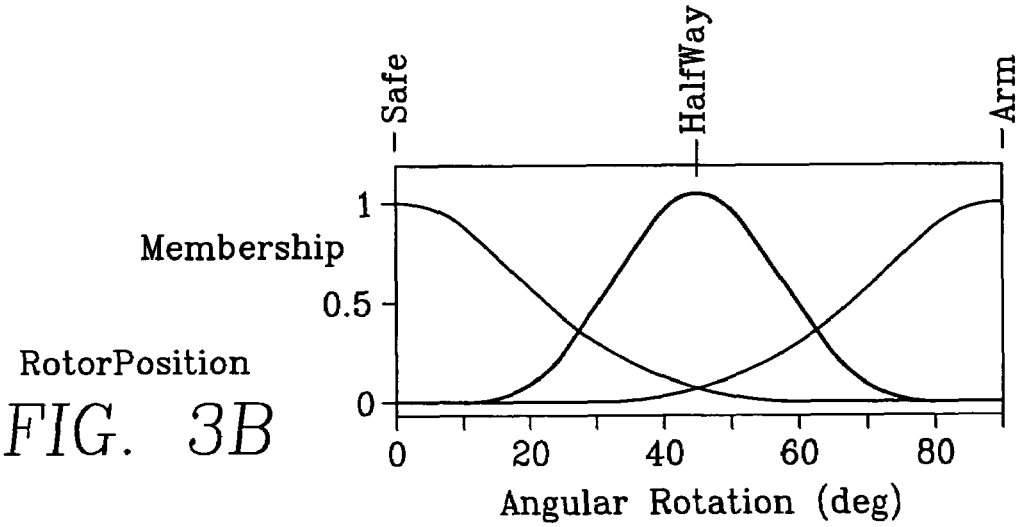
Figure 3C:
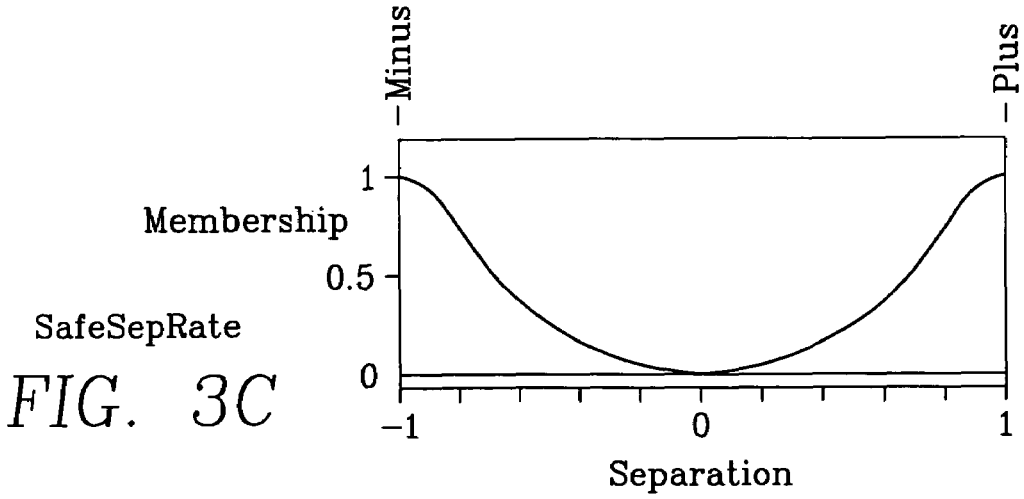
Figure 3D:
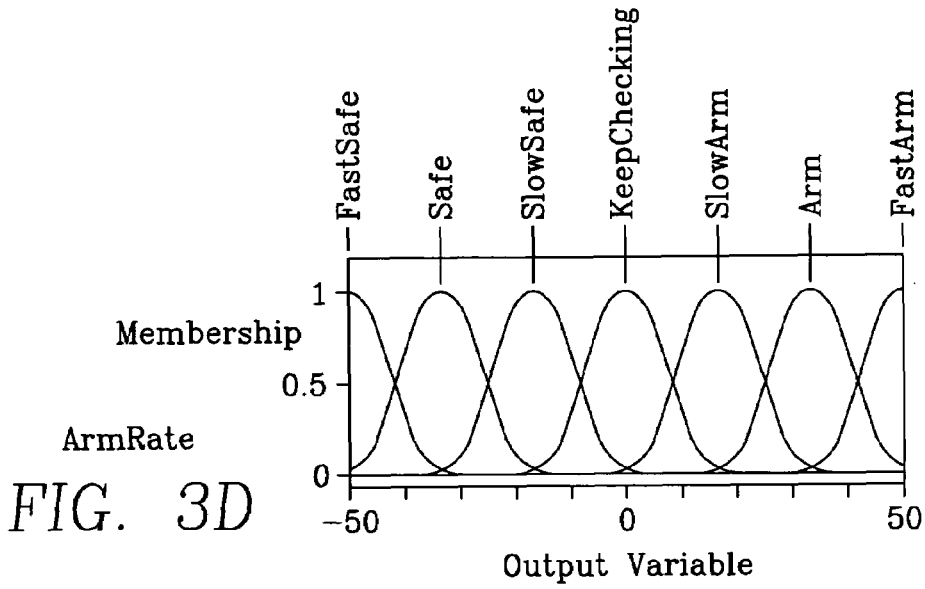

FIGS. 3A-3D show examples of linguistic values represented by Gaussian curves. The "Launcher" membership function is composed of 3 values, titled "VeryClose", "Near", and "Far" (FIG. 3A). The "RotorPosition" membership function is composed of 3 values, titled, "Safe", "Halfway", and "Arm" (FIG. 3B). The "SafeSepRate" membership function is composed of 2 values, titled, "Minus", and "Plus" (FIG. 3C). The "ArmRate" membership function is composed of 7 values, titled, "FastSafe", "Safe", "SlowSafe", "KeepChecking", "SlowArm", "Arm" and "FastArm" (FIG. 3D). It is noteworthy that although Gaussian curves are used in the example, graphical representations of many different forms may be used, such as for example, triangular, bell, trapezoidal, haversine, or exponential.

Referring to FIG. 2, the actual state of the input membership functions 230 is determined by sensors 232. The corresponding linguistic value for the actual state is chosen. For example, referring to FIG. 3A, if the AIM is actually 200 feet from the launcher aircraft then referring to the curves the membership function has a value of about 0.85 (85%) in the VeryClose value, and about 0.15 (15%) in the Near value.

A set of rules are composed to determine the interrelation between the input and output membership functions 240. The rules are composed so as to provided a desired output, such as not impacting the launcher with the AIM. For example, a set of rules for the membership functions previously discussed may include:

1) If Launcher is VeryClose, and RotorPosition is Safe, and the SafeSepRate is Plus, then ArmRate is SlowArm 2) If Launcher is Near, and RotorPosition is HalfWay, and the SafeSepRate is Plus, then ArmRate is Arm.

3) If Launcher is Far, and RotorPosition is Halfway, and the SafeSepRate is Plus, then ArmRate is FastArm.

4) If Launcher is Far, and RotorPosition is Arm, and the SafeSepRate is Minus, then ArmRate is SlowSafe.

5) If Launcher is Near, and RotorPosition is Arm, and the SafeSepRate is Minus, then ArmRate is Safe.

6) If Launcher is VeryClose, and RotorPosition is Arm, and the SafeSepRate is Minus, then ArmRate is FastSafe.

These rules are flexible and may be adjusted and fine tuned as conditions warrant. In addition, the rules do not have to follow a particular order since they are all considered at once. The rules are applied to the input membership functions 250, testing them and producing conclusions, creating a set of output membership functions corresponding to each rule continuously during the flight. The output membership functions represent the interrelation of the weights of the input membership function values and the rules applied to them. Subsequently, a single output signal is created by combining the output membership functions and finding the centroid of the results 260. The processor repeats the method in a loop 270, until the AIM ends its flight, according to the processor's speed.

Figure 4:
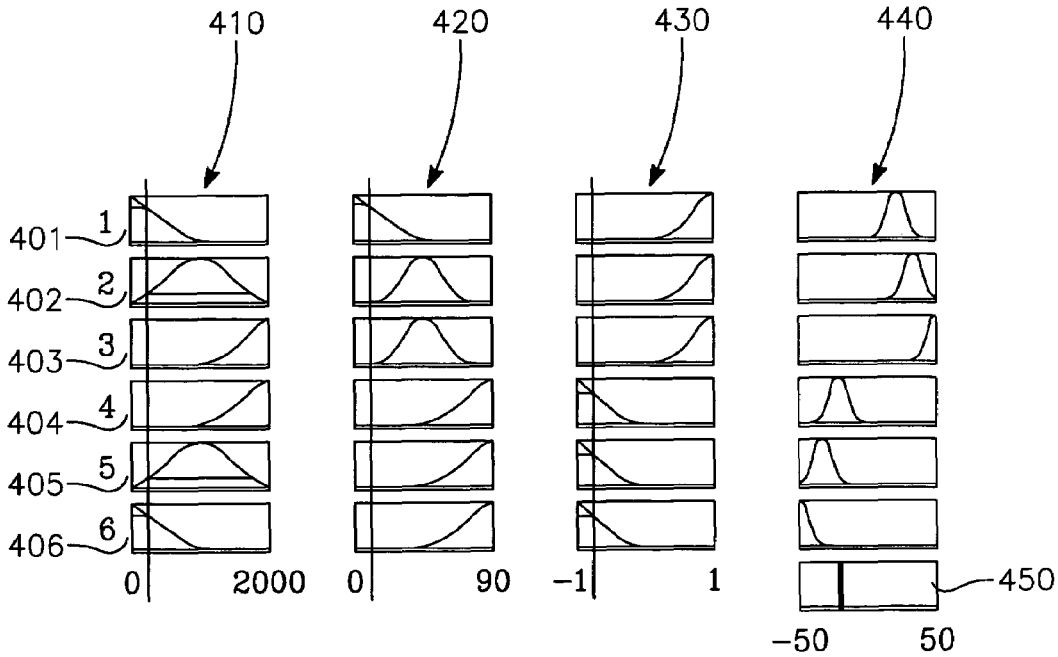
FIG. 4 illustrates graphical representations of examples of output membership functions according to embodiments of the present invention.

FIG. 4 is an illustration of graphical representations for the example discussed. The actual states of the input membership functions are: Launcher=227 feet (distance from Aim to the launcher aircraft) (shown in column 410); RotorPosition=10.3 (the rotor position is 10.3 degree from the safe condition (shown in column 420); SafeSepRate=−0.723 (the distance between the AIM and the launcher aircraft is decreasing) (shown in column 430). Rows 401-406 show the linguistic value curves for each of the rules (listed above) with a vertical line denoting the actual state. Column 440 shows the linguistic value curves for the output membership function for each rule. The linguistic value curves for the output membership function are combined and their centroid is found, represented by the vertical line in the bottom graph, 450. In this example, the single output signal of the given actual states is −18 radians/second, which is a member of the Safe curve (see FIG. 3D). This single output signal is sent to the controller of the S&A device, causing the rotor to move toward the safe condition. This computation is repeated, continuing to send single output signals, corresponding to the actual states of the components, to the controller throughout the flight of the AIM.

Figure 5A:
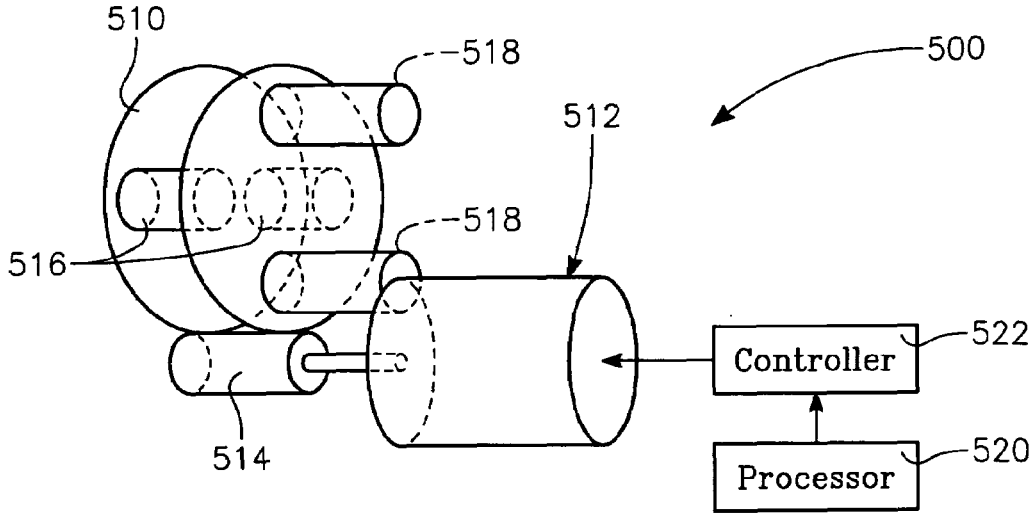
FIGS. 5A-5B are diagrams of possible applications of embodiments of the present invention.

An embodiment of the present invention may be used to operate an electromechanical S&A device such as that shown in FIG. 5A. The rotor 510 which is shown in the safe position, is rotated by the stepper motor 520 via a worm gear 514. When rotor is rotated 90 degrees, the detonators 516 are aligned with the explosive output leads 518. The processor 520 applies a rule based computation according to embodiments of the present invention and constantly signals the controller 522 to move the rotor towards the safe or the armed condition corresponding to the output.

Figure 5B:
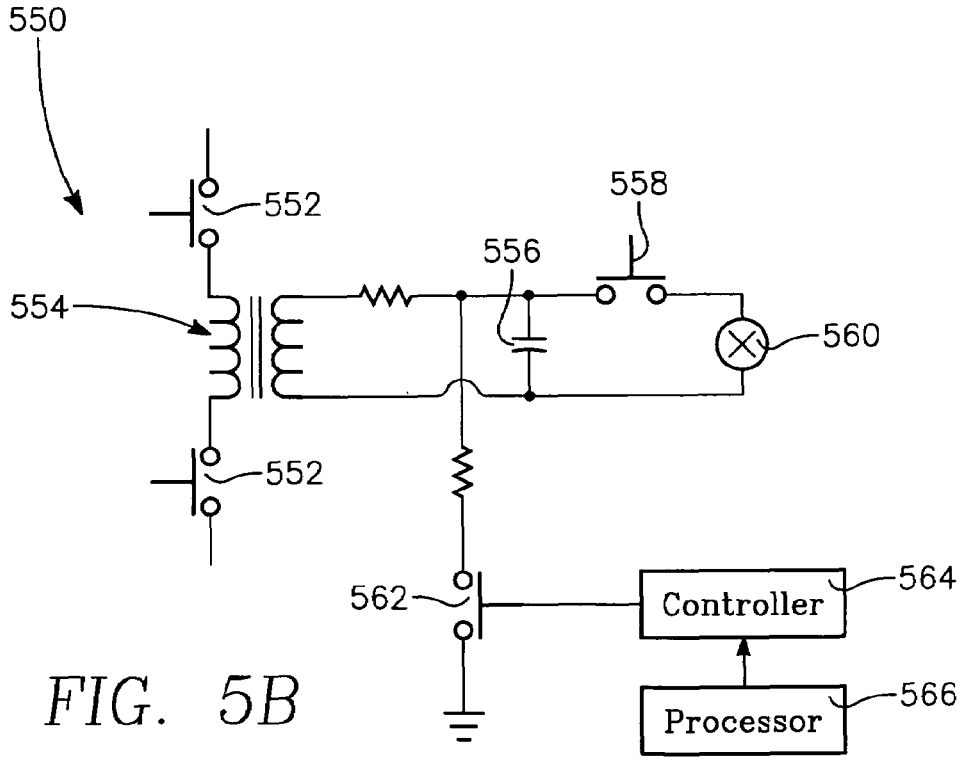

Another embodiment of the present invention may be used to operate an electronic S&A device such as that shown in FIG. 5B. Closing of the charge switches 552 energizes the transformer 554, charging the firing capacitor 556. The S&A device is considered to be in the armed condition when the firing capacitor 556 is charged. When the firing switch 558 is closed, the firing capacitor 556 dumps its energy through the "slapper" detonator 560 and the fuze fires. In an embodiment of the present invention, a discharge switch 562 is added, which when activated will remove the charge from the firing capacitor 556, thereby putting the S&A device in the safe condition. The processor 566 applies a rule based computation according to embodiments of the present invention and constantly signals the controller 564 to command the discharge switch 562 to open and close, causing the S&A device to be in the safe or the armed condition corresponding to the output.

Although the description above contains much specificity, this should not be construed as limiting the scope of the invention but as merely providing an illustration of an embodiment of the invention. Thus the scope of this invention should be determined by the appended claims and their legal equivalents.

What is claimed is:

1. A method for controlling the operation of a safe and arm device comprising:

determining membership functions defining values of inputs and outputs necessary to operate the safe and arm device;

determining linguistic values for each of said input and output membership functions, wherein the probable state of each of said linguistic values is graphically represented;

determining repeatedly an actual state of each of said linguistic values of said input membership functions;

composing rules for an interrelation between said input and output membership functions;

applying repeatedly a rule based computation to said input membership functions resulting in output membership functions;

determining repeatedly a centroid of a composite area of said output membership functions, said centroid being a single output signal; and sending repeatedly said single output signal to a controller operating said safe and arm device to affect the condition of said safe and arm device alternatively towards a safe position or an armed position.

2. The method of claim 1, wherein said membership functions comprise a launcher, a rotor position, a safe separation rate, and an arm rate.

3. The method of claim 1, wherein said rule based computation comprises a fuzzy logic software.

4. The method of claim 3, wherein said fuzzy logic software utilizes a Mamdani or a Takagi-Sugeno-Kang type fuzzy logic model.

5. The method of claim 1, wherein said safe and arm device is an electro-mechanical device.

6. The method of claim 1, wherein said safe and arm device is an electronic device.

7. The method of claim 1, wherein said safe and arm device is coupled to an air intercept missile (AIM).

* * * * *